United States Patent [19]

Yagi

[11] 4,081,146

[45] Mar. 28, 1978

[54] GARBAGE DISPOSAL APPARATUS

[76] Inventor: Toshio Yagi, 5-2-15 Shinzaike Honmachi, Himeji, Japan

[21] Appl. No.: 730,219

[22] Filed: Oct. 6, 1976

[30] Foreign Application Priority Data

Apr. 20, 1976 Japan ..... 51-45276
Apr. 20, 1976 Japan ..... 51-45277

[51] Int. Cl.[2] ..... B02C 7/11

[52] U.S. Cl. ..... 241/152 A; 241/247; 241/257 R; 241/259.3

[58] Field of Search ..... 241/152 A, 186 A, 244, 241/246, 247, 248, 257 R, 257 G, 258, 259.3

[56] References Cited

U.S. PATENT DOCUMENTS

| | | | |
|---|---|---|---|
| 1,691,196 | 11/1928 | Jirotka | 241/259.3 X |
| 1,724,318 | 8/1929 | Schuchardt | 241/248 |
| 2,495,948 | 1/1950 | Taylor | 241/248 X |
| 2,985,211 | 5/1961 | Letz | 241/248 X |
| 3,568,940 | 3/1971 | Merges | 241/247 X |
| 3,845,909 | 11/1974 | Johansson | 241/247 X |
| 3,902,673 | 9/1975 | Berggren | 241/257 R X |

FOREIGN PATENT DOCUMENTS

| | | | |
|---|---|---|---|
| 641,298 | 8/1950 | United Kingdom | 241/247 |

*Primary Examiner*—Roy Lake
*Assistant Examiner*—Howard N. Goldberg
*Attorney, Agent, or Firm*—Merriam, Marshall & Bicknell

[57] ABSTRACT

This disclosure deals with apparatus for grinding kitchen wastes or garbage into particles sufficiently small that they may be carried away by ordinary sewage facilities. The apparatus includes means forming a passage into which the wastes are disposed, a spirally grooved or screw-shaped member rotatably mounted in the passage, a pair of grinding members mounted at the outlet of the passage, the grinding members being movable relative to each other and forming a waste receiving space therebetween, and impeller means in the space for moving waste from the passage into the space. The screw-shaped member both shreds the waste and moves the wastes through the passage. The grinding members grind the waste between them into a paste-like consistency and the impeller also shreds the waste.

10 Claims, 3 Drawing Figures

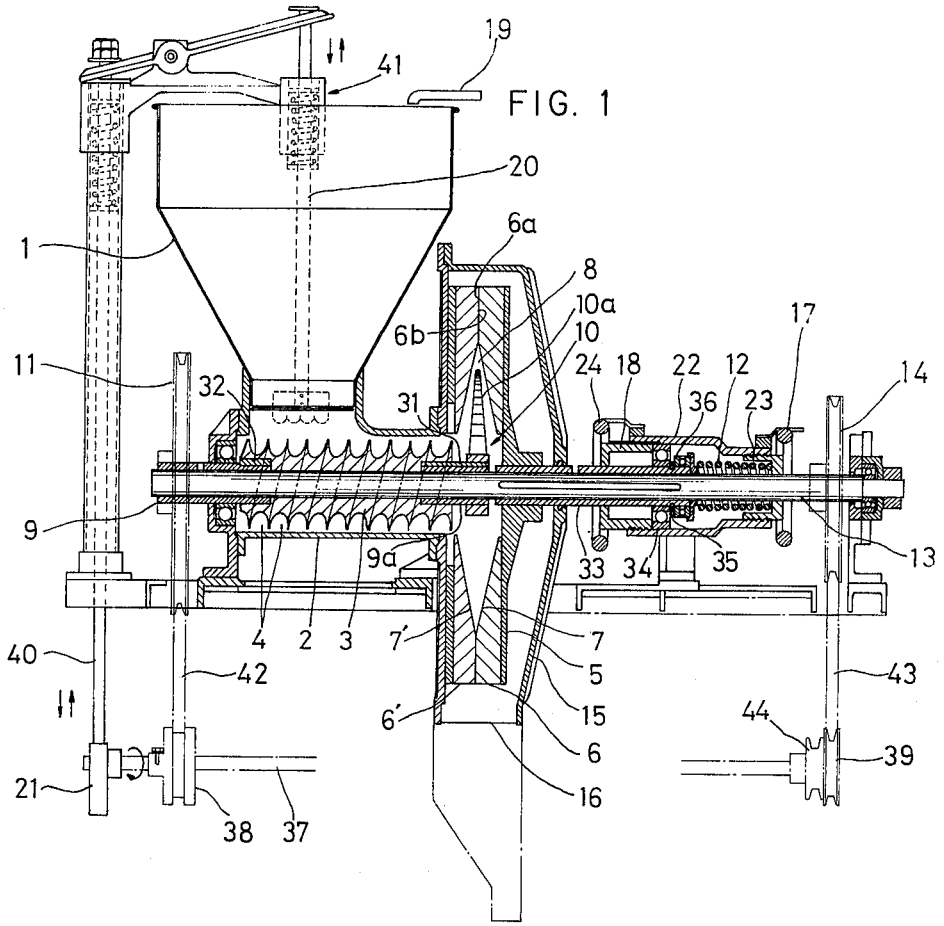
FIG. 1
FIG. 2
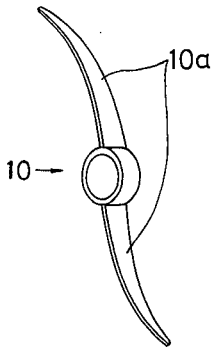

GARBAGE DISPOSAL APPARATUS

BACKGROUND OF THE INVENTION

The present invention relates to an apparatus for disposing of garbage and kitchen wastes. Kitchens and cuisines produce a large quantity of waste matter in the form of foodstuffs and leftovers. Waste matter and leftovers such as vegetable refuse and meats which are produced in kitchens and cuisines, are generally disposed of in urban areas in the following manner:

First, they are temporarily put into a vinyl sack or into a garbage can, then are gathered at a fixed place outside the kitchen, carried away by a garbage truck, and finally are burnt up in an incinerator or carried away to a garbage disposal area.

However, such disposal methods cause several problems as follows:

1. Garbage is usually so wet that the incineration is difficult, and flies or maggots hatch when such kitchen wastes are left for a long period of time, thereby producing unsanitary conditions and emitting an offensive odor, thus producing a kind of environmental pollution.

2. Collection and transportation of such waste matter require extensive expenses from personnel and fuel viewpoints.

3. Great expenditures are required for building incineration facilities or providing areas where waste matter can be disposed of.

Thus, disposal of such waste matter has become nowadays the greatest perplexing problem in urban administration, and the concerned parties always take great pains to meet the problem.

The present invention aims to overcome this perplexing problem, enabling such kitchen wastes to be easily and readily treated, and thereby eliminating refuse-pollution.

SUMMARY OF THE INVENTION

It is therefore a general object of the present invention to provide improved apparatus for shredding and grinding kitchen wastes and refuse into small pieces which may be dispersed in water and carried away by a sewage system to a sewage disposal plant.

Apparatus in accordance with the invention comprises means forming a passage into which wastes are disposed, a screw-shaped member rotatably mounted in said passage, a pair of relatively rotatable members mounted at the outlet of said passage, said rotatable members forming a space therebetween and said space being located to receive wastes from said outlet of said passage, and impeller means rotatably mounted adjacent said outlet and moving wastes into said space.

The screw-shaped member and the relatively rotatable members shred and grind the wastes into small particles which may be carried away by a sewage system. The impeller means both moves the wastes into the space and shreds the waste.

The passage may be horizontally or vertically oriented.

BRIEF DESCRIPTION OF DRAWINGS

The present invention will be now described by referring to the accompanying drawings, in which:

FIG. 1 is an elevational view partly in section of an embodiment in accordance with the present invention, wherein the main mechanism is horizontally disposed;

FIG. 2 is a perspective view of an impelling means of the mechanism shown in FIG. 1.

DETAILED DESCRIPTION OF INVENTION

Figure 3:
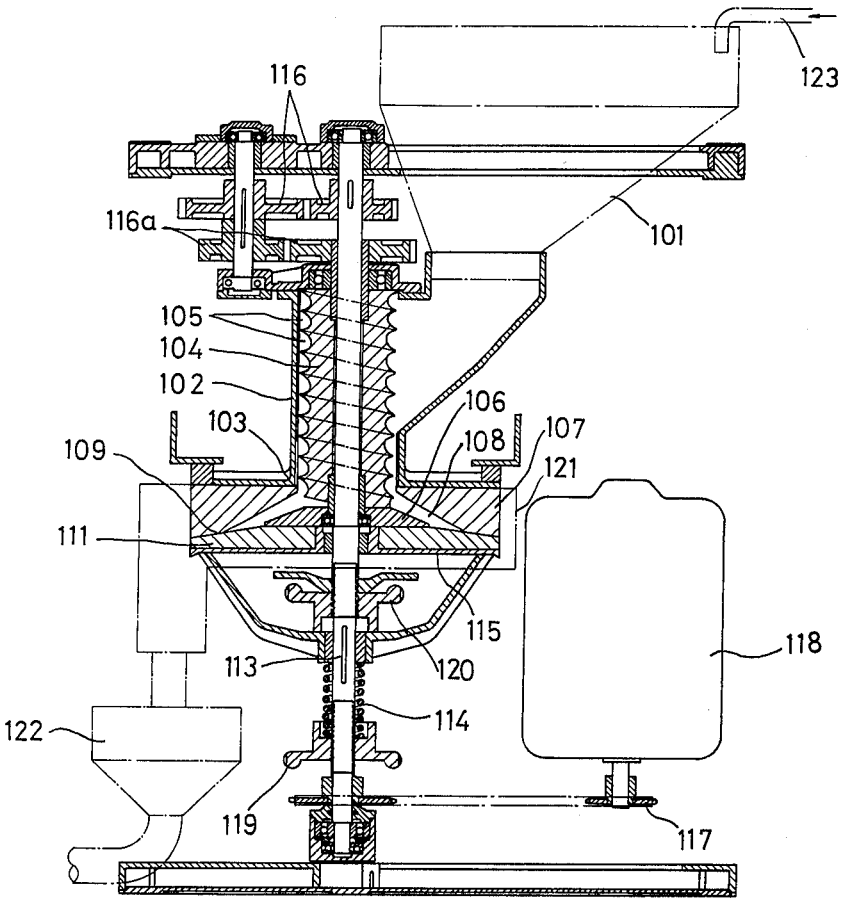
FIG. 3 is an elevational view partly in section of another embodiment in accordance with the present invention, wherein the main mechanism is vertically disposed.

Referring to FIG. 1 which shows an embodiment with the main mechanism horizontally disposed, a main cylinder 2 which communicates with a hopper 1 for receiving kitchen refuse, is horizontally disposed. A worm grinding member 3, of which the circumferential face thereof is provided with a spiral groove 4, is journalled in a passage formed by the main cylinder 2. An annular grinding member 6′ is secured to the frame or cylinder 2, while another annular grinding member 6 is secured to a supporting disc 5.

Oppositely tapered surfaces 7 and 7′ of the grinding members 6 and 6′ define a circular space 8 having a V-cross section, and the center of the space 8 is open and is connected to the outlet of the passage in the cylinder 2 to receive waste matter to be treated. In this V-shaped space 8, an impelling means 10 having a plurality of blades 10*a* curving in arcs as shown in FIG. 2, is coupled to turn with the rotary member 3. The grinding member 3 is rotatably supported by sleeve bearings 9 and 9*a* on a shaft 13, the bearing 9*a* being connected to the impelling means 10 and the member 3 by a key 31, and the bearing 9 being connected to the member 3 by a key 32. The supporting disc 5 is secured to the shaft 13 by a sleeve 33 which is secured to both the disc 5 and the shaft 13. The rotary grinding member supporting disc 5 is spring-loaded by a spring 12 so that the grinding members 6 and 6′ are pressed into contact with each other. The members 6 and 6′ have flat adjoining surfaces 6*a* and 6*b* which are pressed into engagement when the machine is not in operation.

The grinding members 3, 6 and 6′ used in this apparatus are preferably made of a grinding stone material such as carborundum or a natural grinding stone or artificial member having rough surfaces provided by calcining rough and hard raw material, thus producing a better grinding and shredding effect.

The spirally grooved grinding member 3 and the blades 10 are rotated together by a transmission pulley 11 fastened to the sleeve bearing 9. The rotary grinding member 6 and supporting disc 5 are rotated by a transmission pulley 14 secured to the shaft 13.

Sleeve 9 and shaft 13 are rotated at a speed ratio preferably in the range of approximately 2:3 – 2:5 and most desirably of approximately 1:2, or may be rotated reversely of each other so that the relative rotation of blades 10 and grinding member 3 to grinding member 6 increases the grinding and kneading effects.

The frame of the machine includes a protective cover 15 which prevents outward scattering of waste matter to be treated. A discharge outlet 16 is provided below the grinding members 6 and 6′ and is adapted to communicate with a sewage line.

An end cap 23 is driven manually by a wheel 17 and threaded into a tubular housing 22 to adjust the compressive force of the spring 12, while another cap 18 is manually driven by a wheel 24 and likewise threaded in the housing 22. The housing 22 is attached to the machine frame and connected to the sleeve 33 by a ball bearing 34, and the cap 18 holds the bearing 34 in place against a snap ring 35 on the sleeve 33. The spring 12 bears against a bearing 36 which also engages the ring 35, and thereby urges the sleeve 33 and the disc 5 in the direction of the member 6'. The gap or distance between the members 6 and 6' may be adjusted by changing the pressure of the spring 12 using the wheel 17.

A waste matter forcing device 20 is vertically reciprocated by means of a cam 21. The cam 21 is attached to a drive shaft 37 which also supports two pulleys 38 and 39. A push rod 40 engages the cam 21 and operates a vertically reciprocating plunger mechanism 41 which moves waste from the hopper 1 to the worm member 3. Belts 42 and 43 connect the pulleys 38 and 11 and the pulleys 39 and 14, and the different diameters of the pulleys produce the desired speed ratios. The shaft 37 may be driven using another pulley 44, for example.

Description will be now made of how this apparatus is operated.

Kitchen waste or refuse placed in a hopper 1 falls onto the rotary grinding member 3 and is forced into cylinder 2 by the device 20, and then moved within the passage formed by the cylinder 2 along the spiral groove 4 by the rotation of the grinding member 3, which preliminarily grinds the refuse. Since the member 3 serves both to grind the waste and to move it through the passage, the member 3 may be referred to as a grinding and impelling member. The refuse then reaches the V-shaped space 8 where the refuse is kneaded by the blades **10*a* and forced by member 3 and the blades 10*a* centrifugally outwardly along the beveled surfaces 7 and 7', which form the space 8, by means of the rotary force thereof. Pressing force produced by rotation of the member 3 and the blades 10 causes the rotary grinding member supporting disc 5 to be moved against the spring 12, thereby producing a gap between the flat surfaces 6*a* and 6*b* of the members 6 and 6'. The kitchen refuse is forced to enter this gap and then is ground and crushed between the grinding members 6 and 6' as the rotary supporting disc 5** continues to rotate.

Addition of water by means of a water supply pipe 19 imparts fluidity to thus shredded and ground kitchen refuse, permitting it to flow out from the apparatus through the discharge outlet 16.

If the kitchen refuse includes hard solid matter, such as nails which are difficult to grind, the rotary grinding member supporting disc 5 is automatically moved against the spring 12 to increase the size of the gap, and the solid matter is discharged, thus preventing damage to the grinding members.

Referring to FIG. 3 which shows an apparatus very similar to that of FIG. 1 but with the main mechanism vertically disposed, a rotary worm shaped grinding member 104 is provided in a passage formed by a vertical cylinder 102 which communicates with a hopper 101 into which waste matter is placed.

The rotary grinding member 104 is secured at the lower portion thereof to an annular grinding member 106 having a truncated cone shape in cross-section and the member 104 is provided at the circumferential surface thereof with a spiral groove 105. A fixed grinding member 107 is fixed to a frame 103 integral with the vertical cylinder 102 and is centrally tapered so as to form a conical space 108 between it and a rotary grinding member 111. The rotary grinding member 111 is fixed on a turn table 115 and biased by a spring 114 against the grinding member 107 at 109. Turntable 115 can turn around and slide along a shaft 113.

Member 111 is rotated together with the shaft 113 by a transmission system 117 and a motor 118. The spirally grooved rotary grinding member 104 rotates about shaft 113 at a reduced speed through two sets of gears 116 and **116*a*. The motor 118 drives the shaft 113 by a chain and sprockets, the shaft 113 drives the member 111 and the set 116 of gears, the set 116 drives the set 116*a* of gears, and the set 116*a* drives the members 104 and 106. The member 107 is fixed to the frame. Different rotative speeds are obtained by different tooth ratios of the sets 116 and 116*a*** of gears.

A nut 119 is threaded on the shaft 113 to adjust the force of the thrusting spring 114. A wheel 120 is threaded on shaft 113 to adjust the gap between the members 111 and 107. A protective cover 121 prevents scattering of waste matter to be treated. A discharging conduit is generally designated by the numeral 122, and a water supply pipe by the numeral 123.

The speed change mechanism including the gear sets 116 and **116*a* gives a predetermined ratio of the rotation of the members 104 and 106 to that of the member 111**. In this embodiment, the two sets of grinding members rotate reversely of each other or in a ratio preferably of approximately 1:2, thereby producing a difference in feeding and discharging amounts of waste matter to be treated, thus improving grinding effect.

Description will be now made on how this apparatus is operated in use.

Kitchen refuse put into the hopper 101 is forwarded to the grinding member 104 by a positive forcing device (not shown) which may be similar to the mechanism 20, and then moved downwardly within the passage of the vertical cylinder 102. The kitchen refuse is preliminarily ground by shredding and grinding action produced by rotation of the spirally grooved rotary grinding member 104 and reaches the space 108, where the kitchen refuse is ground into pieces between the upper fixed grinding member 107 and the lower rotary grinding member 111. At this time, the grinding member 106 having a truncated cone shape, which is attached to the lower end of the spirally grooved rotary grinding member 104, applies both grinding and forcing actions to the kitchen refuse in the space 108 to be treated. Increased amounts of the kitchen refuse supplied into the space 108 increases internal pressure and tends to push down on the rotary grinding member 111 and against the thrusting spring 114, so that the waste matter is forced to enter between the fixed member 107 and the rotary member 111. The waste matter is efficiently ground and crushed into the form of paste by rotation of the rotary member 111 combined with the thrusting action by the thrusting spring 114. Addition of water from the water supply pipe 123 may impart fluidity to thus impasted waste matter causing it to flow out from the apparatus through the discharging conduit 122 to a sewage system.

The strength of the thrusting spring 114 may be adjusted by turning the wheel 119 clockwise or counterclockwise, so that the contact-pressure of the rotary member 111 against the fixed member 107 may be adjusted and the amount of waste matter to be treated being fed into the hopper may consequently be adjusted, thus providing adjustment in grinding action.

The rotary member 111 can be mounted to and removed from the frame 115 by turning the wheel 120. The protective cover 121 envelops the grinding members 107 and 111 for prevention of outward scattering of the waste matter.

The waste matter is collected in the discharging conduit 122 before flowing out to a sewage system.

Apparatus in accordance with the present invention grinds and crushes kitchen refuse, and converts it in such a condition so as to be directly fed to a sewage system together with added water for disposal in an existing sewage treatment plant.

Accordingly, apparatus in accordance with the present invention provides the following advantages:

1. Labor expenses and facilities required for collection and incineration of kitchen refuse can be eliminated, thus saving a great amount of expense.
2. This apparatus prevents flies, maggots or pathogenic bacteria from hatching or inhabiting the refuse, thus emitting no offensive odor.
3. A traffic snarl caused by collection and transportation of waste matter can be avoided.
4. Air pollution can be avoided.

What is claimed is:

1. A garbage disposal apparatus comprising:

cylinder means forming a passage adapted to receive kitchen wastes;

a spirally grooved grinding and impelling member journalled within said passage to initially grind the kitchen wastes and move the wastes along the cylinder means to an outlet of said passage;

a pair of grinding members disposed at the outlet of said passage to further grind the wastes, said members being spring biased toward each other, one of said pair of grinding members being rotatable relative to the other;

said spirally grooved grinding member and said pair of grinding members being made of a grinding stone material;

a space defined between said pair of grinding members; and a movable impelling means located within said space and moving said wastes centrifugally from said space.

2. An apparatus as claimed in claim 1, and further including a hopper communicating with said passage, and means for moving the garbage within said hopper into said passage.

3. An apparatus as claimed in claim 1, wherein said impelling means has blades curved in arcs.

4. An apparatus as claimed in claim 1, wherein said spirally grooved grinding and impelling member rotates reversely of said rotary grinding member.

5. An apparatus as claimed in claim 1, wherein the speed ratio of said spirally grooved grinding and impelling member to said one of said pair of grinding members is in the range of from approximately 2:3 to 2:5.

6. An apparatus as claimed in claim 1, wherein the speed ratio of said spirally grooved grinding and impelling member to said one of said pair of grinding members is approximately 1 to 2.

7. An apparatus as claimed in claim 1, wherein said pair of grinding members are generally annular and include adjoining surfaces adjacent the outer peripheries thereof, and further including spring means for urging the grinding members of said pair toward each other.

8. Garbage disposal apparatus comprising first and second grinding members mounted closely adjacent one another, one of said first and second grinding members being rotatable about an axis relative to the other, and one of said first and second grinding members being axially movable relative to the other;

spring means for urging said first and second grinding members toward each other;

said first and second grinding members having adjoining generally flat surfaces adjacent their outer peripheries, and being spaced apart to form a space therebetween adjacent their inner peripheries;

a rotatable impelling means in said space for moving garbage toward said adjoining surfaces;

and worm means for initially grinding and moving garbage into said space adjacent said impelling means, said grinding members and said worm means being made of a grinding stone material.

9. Apparatus as claimed in claim 8, wherein said impelling means further shreds said garbage.

10. Apparatus as claimed in claim 9, wherein said impelling means includes a plurality of shredding blades.

* * * * *